US005730069A

United States Patent [19]

Coolidge et al.

[11] Patent Number: 5,730,069

[45] Date of Patent: Mar. 24, 1998

[54] LEAN FUEL COMBUSTION CONTROL METHOD

[75] Inventors: Dennis W. Coolidge, Gillette, Wyo.; Timothy J. Kuhn, Newbury, Mich.; Franklin G. Rinker; James G. Powers, both of Perrysburg, Ohio

[73] Assignee: Tek-Kol, LaJolla, Calif.

[21] Appl. No.: 550,535

[22] Filed: Oct. 30, 1995

[51] Int. Cl.[6] ..... F23N 5/00

[52] U.S. Cl. ..... 110/187; 110/189; 110/190; 110/185

[58] Field of Search ..... 110/229, 230, 110/232, 245, 210, 185, 186, 187, 188, 189

[56] References Cited

U.S. PATENT DOCUMENTS

| | | | |
|---|---|---|---|
| 3,223,058 | 12/1965 | Tanner | 110/187 |
| 4,038,032 | 7/1977 | Brewer et al. | 23/230 A |
| 4,441,435 | 4/1984 | Miyamoto | 110/245 |
| 5,040,972 | 8/1991 | Kleinhenz et al. | 432/72 |
| 5,044,287 | 9/1991 | Furukawa et al. | 110/346 |
| 5,140,916 | 8/1992 | Williams | 110/347 |
| 5,158,024 | 10/1992 | Tanaka et al. | 110/186 |
| 5,189,963 | 3/1993 | Mann | 110/190 |
| 5,372,497 | 12/1994 | Coolidge et al. . | |
| 5,401,364 | 3/1995 | Rinker . | |
| 5,449,854 | 9/1995 | Yap | 588/206 |

*Primary Examiner*—Ira S. Lazarus
*Assistant Examiner*—Nhat-Hang H. Lam
*Attorney, Agent, or Firm*—Polster, Lieder, Woodruff & Lucchesi, L.C.

[57] ABSTRACT

A method and apparatus are provided to control the burning of a lean hydrocarbon containing gas stream under stable conditions using a combination of control logic and hardware. Temperature within the combustor is controlled by using a plurality of staging valves that adjust the amount of oxygen and auxiliary fuel supplied to the combustor burner. Oxygen level is controlled by using actuated butterfly valves that control the flow of primary air to the combustor. The system has pressure control valves for anticipating and compensating for pressure changes and resulting air flow changes as well as temperature monitors and transmitters for anticipating and correcting temperature drops.

20 Claims, 1 Drawing Sheet

LEAN FUEL COMBUSTION CONTROL METHOD

BACKGROUND OF THE INVENTION

This invention relates to a benefication process for treating noncaking, noncoking coal to form char utilizing process derived gaseous fuel. More particularly, this invention relates to a process for treating noncaking, noncoking coal to form char with high sensible heat oxygen deficient gas streams produced by the controlled combustion of process derived gaseous fuel having variable calorific heating value.

A principal object of coal benefication is to increase the calorific heating value or amount of thermal energy of the coal which may be released during a subsequent combustion process. One method of increasing the thermal energy released during combustion of coal is to decrease the amount of moisture by subjecting the coal to a drying process. It will be appreciated that moisture in coal has no heating value and, although not environmentally harmful, facilitates depletion of evaporation of a portion of thermal energy released during combustion of coal.

Another known method of increasing the thermal energy released during combustion of coal is to decrease the amount of volatile matter within the coal. The amount of volatile matter within coal may be decreased by subjecting the coal to mild gasification by pyrolysis. Pyrolysis of coal in an oxygen deficient atmosphere removes volatile matter, e.g. low boiling point organic compounds and heavier organic compounds, by breaking chemical bonds during the heating process. Breaking of chemical bonds within coal during the heating process increases the relative percentage of elemental carbon which provides most of the calorific heating value when coal is burned.

Although various methods of increasing the thermal energy released during combustion of coal are known, many of the known methods require large volumes of continuously flowing streams of oxygen deficient gas for convective heat transfer. An oxygen deficient gas as used herein refers to a gas generally less than 5% oxygen by weight.

Heretofore, oxygen deficient gas streams typically have been produced using well known air separation technologies such as cryogenic distillation, membrane separation and pressure swing absorption. Although the known methods of producing oxygen deficient gas streams for coal drying and mild gasification processes have been proven to perform satisfactorily in certain applications, these technologies are cost ineffective when considered for large processing needs like mild coal gasification, coke preheating and the like. Large mild coal gasification systems may range up to 8,000 square feet and may use 5,000 to 10,000 standard cubic feet of oxygen deficient gas per hour per square foot of cross section for thermal treatment of coal and/or oil shale whether the coal and/or oil shale is to be dried or fractioned into solid and gaseous phase components.

The present invention is directed to a process for treating noncaking, noncoking coal to form char. The process employs high sensible heat oxygen deficient gas streams for consecutive drying and pyrolytic coal treatment processes. The high sensible heat containing gas streams are renewed using products of combustion from the combustion of a process derived gaseous fuel having variable calorific heating value.

Combustors commonly are used to burn hydrocarbon compounds contained in lean fuel gas streams. If the combustion is intended only to dispose of the hydrocarbons, the resulting clean flue gas may be hot discharged directly into the atmosphere. On the other hand, if the flue gas contains contaminants, cooling the flue gas and downstream cleanup, such as particulate removal and/or acid scrubbing, may be required before discharge. With this type of incineration, the amount of combustion air may well exceed that required to burn the hydrocarbons. Typical oxygen concentrations in the discharged flue gas are in the range of 5% to 10%.

It will be appreciated that the mild gasification process, albeit a thermal process, for the formation of char starts with a noncaking, noncoking coal and differs substantially from a process utilized for the formation of coke. The essential difference employed in this invention is the operability of a mild gasification process as manifested in the ability to control both the mass flow ratio as compared with the dried coal and the temperature of the high sensible heat pyrolysis gas so as to have precise control over the residual volatile content of the char formed. It will be further appreciated that coupled with the control of the mass ratio and temperature of the pyrolysis gas stream is the need for precise control over the environmental and safety aspects of the mild gasification process. Moreover, but not least, is the need to combust and consume all of the low calorific heating value process derived gaseous fuel so as to render the process economical to operate.

A process derived gaseous fuel to be processed in such a combustor generally contains a lean fuel mixture of hydrocarbons. Typically these streams have a heat content of 20 to 80 BTU per standard cubic foot of gas. Such a low calorific heating value fuel will not sustain continuous spontaneous combustion and, therefore, requires a constant source of flame for ignition, such as a high calorific heating value fuel, i.e. natural gas, fueled burner to insure near total reaction of the hydrocarbons with the oxygen in the combustion air. The auxiliary fuel, such as natural gas, is added to achieve temperatures in the range of 1500° F. to 2000° F. to form high sensible heat oxygen deficient gas streams and to insure complete destruction of the hydrocarbons and provide for stable operation.

Sustaining combustion of low calorific heating value fuel gas is even more difficult at reduced oxygen concentrations. First, the kinetic rate of the oxidation reaction is slowed when the concentration of hydrocarbons and oxygen is low. Additionally, the large volume of oxygen deficient inert gases typically entering with the hydrocarbon-containing stream tend to quench the reaction. Good mechanical design of the combustor is essential to provide thorough mixing of the hydrocarbon-containing gas stream with combustion air and to provide intimate incorporation of the heat source with the incoming gas streams. Even with state-of-the-art mechanical design, experience has taught that the oxidation reaction often is substantially slowed or even stopped due to factors unrelated to combustor design. Such factors include variations in the hydrocarbon concentration, variations in process pressures, and variations in one or more fuel gas flows to the combustor. It is difficult to burn low heating value fuel gas at a desired low oxygen concentration and temperature. Combustor operation is unstable, resulting in frequent total loss of hydrocarbon combustion accompanied by a sudden drop in combustor flue gas temperature.

Typically, lean hydrocarbon streams are burned using a sufficiency of auxiliary fuel, such as natural gas. Adding the natural gas insures stability of combustion. However, using natural gas also causes excess heat generation, reduces the efficiency of the overall process, and increases the formation of nitrogen oxides. For example, one process in which this invention finds application uses the heat obtained from the burning of the hydrocarbon-containing process derived gas to heat coal in a coal pyrolysis process. That is, hot gas from the combustor is used to heat a bed of coal. Hydrocarbons are liberated from the coal, creating a lean hydrocarbon process derived fuel gas with a calorific heating value of between 20 and 50 BTU per standard cubic foot and a temperature approximately 200° F. Some of the gas is recycled back to the combustor where it is burned, along with natural gas and oxygen, to form a high sensible heat oxygen deficient gas which is returned to the process.

In the coal heating process just described, excess heat required to combust lean hydrocarbon gases can cause overheating in a downstream coal preheating step. Furthermore, excess air also may be used to improve combustion. However, oxygen concentration in excess of 5% in the combustor effluent gas makes it unsuitable for direct use in a process such as drying or pyrolysis of coal.

SUMMARY OF THE INVENTION

It is among the principal objects of the present invention to provide a method and apparatus to control and sustain combustion of lean hydrocarbon gas streams in a gas phase combustor at low oxygen concentrations.

It is another object of the present invention to provide such control using a combination of control logic strategies and hardware elements.

It is another object of the invention to provide such control using low oxygen concentrations so that high sensible heat oxygen deficient gas exiting the combustor can be used in other stages of the process.

Yet another object of the present invention is to provide such control so that any undesirable emissions from the system meet emissions standards by providing complete burnout of volatile organic compounds and generate low levels of carbon monoxide and nitrogen oxides.

In accordance with the invention, generally stated, a method and apparatus are provided to control the burning of a lean hydrocarbon containing gas stream under stable conditions using a combination of control logic and hardware. Temperature within the combustor is controlled by using a plurality of staging valves that adjust the amount of oxygen and auxiliary fuel supplied to the combustor burner. Oxygen level is controlled by using actuated butterfly valves that control the flow of primary air to the combustor. The system has pressure control valves for anticipating and compensating for pressure changes and resulting air flow changes as well as temperature monitors and transmitters for anticipating and correcting temperature drops.

DESCRIPTION OF THE PREFERRED EMBODIMENT

Figure 1:
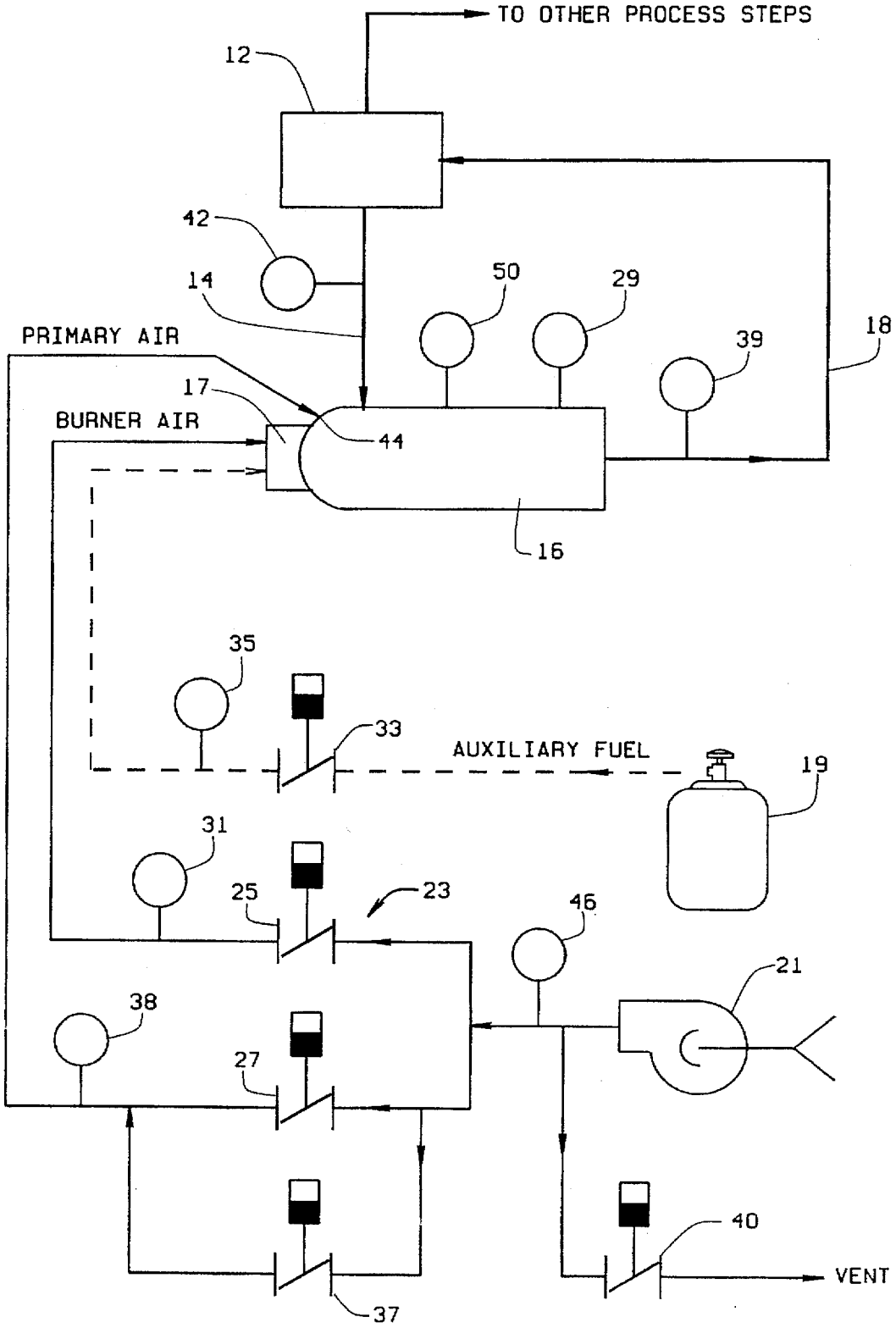
FIG. 1 is a diagram of a coal heating process using the method of the present invention to both burn hydrocarbon fuel in a gas stream exiting the coal pyrolysis process and to provide high sensible heat oxygen deficient gas for continued processing.

FIG. 1 illustrates the system which uses a combustor 16 to both burn hydrocarbon components from a gas stream 14 exiting the main processor 12 and also to supply heat back to the processor 12. In this embodiment, main processor 12 is operated for the purpose of heating coal. It will be appreciated, however, that the present invention may be used with any process requiring the burning of hydrocarbons in a gas stream and the recovery of sensible heat.

The first process gas stream 14, is the lean hydrocarbon gas stream produced by picking up volatile components evolved as the coal is heated in main pyrolysis process 12. Hydrocarbon gas stream 14 enters the combustor 16. Combustor 16 includes a burner system 17. A second process gas stream, indicated by reference numeral 18, is a hot gas stream exiting from combustor 16, which contains no hydrocarbons. Gas stream 18 has a low oxygen content, approximately 0.2% to 0.8%, and is therefore, practically speaking, inert. Gas stream 18 is directed back to main processor 12 to heat a coal bed, not shown, Consequently, the recovered heat generated by combustion of the coal volatiles is used as an integral part in main processor 12. This improves the overall efficiency of main processor 12 by reducing the amount of auxiliary fuel 19, i.e. natural gas, burned for heating the coal bed in main process 12. As a result of the present invention, 70% to 90% of main processor 12 heat required is provided by the combustion of volatiles in hydrocarbon gas stream 14 while 10% to 30% of the heat is provided by the combustion of natural gas.

In the system of the present invention the temperature and oxygen concentration within combustor 16 are controlled for efficient and trouble free operation. The temperature is maintained by controlling the ratio of auxiliary fuel 19 and air from a primary air source 21 entering burner system 17 of combustor 16. It should be noted that primary air source 21 can be a variable speed blower. The air/natural gas flow ratio is typically maintained at 9:1 to 15:1, by volume, while hydrocarbons are being burned. In the present embodiment, burner system 17 is a 17 million BTU per hour natural gas burner. Upon startup of the equipment and before hydrocarbons are available from the main process 12, the natural gas burner 17 will typically fire at a rate in the range of 3 to 17 million BTU/hour. When hydrocarbons are available in hydrocarbon gas stream 14, natural gas burner 17 typically will fire at a rate in the range of 3 to 8 million BTU/hour.

Oxygen concentration within the system is controlled by a two stage air flow control system 23. Control system 23 has a first flow valve 25 and a second flow valve 27. The temperature in combustor 16 is measured by a temperature transmitter 29. The error between the desired temperature (set point) and the actual temperature is used to calculate an output for first flow valve 25. When a higher combustor temperature is desired, more air is sent to burner 17 through flow valve 25. If a lower temperature is desired, less air is sent. The actual flow of air is measured by an air flow transmitter 31. Auxiliary gas 19 flows through a fuel flow valve 33. The rate of flow of auxiliary gas is measured by a fuel flow transmitter 35. The flow of air as measured by air flow transmitter 31 is compared to the auxiliary fuel flow as measured by the fuel flow transmitter 35. An output is then calculated for the fuel flow valve 33. By this feedback control, a strict air-to-fuel ratio is maintained.

Second air flow valve 27 and a trim air flow valve 37 function together with a post-combustor oxygen concentration analyzer 39 to control the proper amount of primary combustion air added to the incoming hydrocarbon gas stream 14 directly into combustor 16. Valves 27 and 37 flow through flow transmitter 38. The oxygen concentration in gas stream 18 is measured by oxygen concentration analyzer 39. The error between the desired oxygen concentration (set point) and the actual or measured oxygen concentration is used to calculate a position for trim flow valve 37. Valve 37 makes small adjustments in primary air flow to maintain the set point oxygen concentration in the combustor closely to a desired set point. Second air flow valve 27 supplies the largest quantity of primary air. Air flow valve 27 operates in a slave mode to trim air valve 37. When trim air valve 37 opens to a predetermined position, air flow valve 27 slowly opens to supply more air. Conversely, when trim air flow valve 37 closes to a predetermined position, air flow valve 27 slowly closes to supply less air to the combustor. For example, in main processor 12 for heating coal, valve 27 is a 16 inch diameter actuated butterfly valve used to supply most of the primary air. Trim air valve 27 is an 8 inch actuated butterfly valve. When trim valve 37 reaches 60% open, valve 27 starts to step open from its current position and continues to step open until either: a) valve 37 closes to less than or equal to 60% open; or, b) the measured oxygen concentration in the combustor exceeds the set point oxygen concentration. Conversely, when trim valve 37 closes to a position less than 30% open, valve 27 starts to step closed and continues to step close until either: a) trim valve 37 opens to greater than or equal to 30% open; or b) the measured oxygen concentration in the combustor becomes less than the set point oxygen concentration. Typical oxygen concentration set points for the coal heating process 12 are in the range of 0.2% to 0.8%.

It will be appreciated that, because neither the flow nor the hydrocarbon concentration of hydrocarbon stream 14 can be reliably measured, the amount of additional air required to burn the hydrocarbons cannot be calculated. With the two stage air flow control system 23, the exact amount of air flow is maintained without the need to know the incoming flow or gas composition of hydrocarbon gas 14. The staging between valve 27 and valve 37 is necessary to provide accurate air flow control over a wide range of flows. The combustion range for incoming hydrocarbon components from main process 12 was from 0 to 36 million BTU/hour.

In addition to the primary controls just described, several anticipatory control functions are used to maintain combustion stability. The pressure and flow of hydrocarbon gas stream 14 entering combustor 16 may vary due to changes in the coal bed depth in the main process 12, gas density changes caused by temperature fluctuations, and due to interactions between the multiplicity of process controls. Furthermore, changes in the hydrocarbon concentration are caused by variations in main process 12 conditions and in coal quality.

Changes in the pressure of hydrocarbon gas stream 14 tend to change the air flow into combustor 16 by applying more or less back pressure to valves 25, 27 and 37. Air pressure is controlled by pressure control valve 40. The main processor 12 pressure is measured by a pressure analyzer 42. From this measurement, a desired air pressure is calculated so that a constant pressure differential is maintained across valves 27 and 37 and across the nozzles 44, where the air enters combustor 16. Pressure control valve 40 is opened or closed to maintain this calculated pressure at a second pressure analyzer 46. This provides a repeatable and stable relationship between air flow and valve position for valves 25, 27 and 37 and minimizes changes and corrections in the air flow. Thus, potential air flow changes are anticipated by pressure changes in the process and corrective action is taken by adjusting one valve, i.e. pressure valve 40. Alternatively, the air pressure in the system could be adjusted by the activation of the primary air source, i.e. variable speed blower 21, activated by a feed back from the pressure analyzer 46. Frequent adjustments to and possible interactions between valves 25, 27 and 37 are avoided.

A surge of lean hydrocarbon gas stream 14 to the combustor will cause rapid quenching of the combustion reaction. A temperature drop or "crater" of over 700° F. may be seen in less than 30 seconds. A crater typically has an initial downward drift followed by a rapid temperature plunge. Following the temperature plunge, restart of combustion may not be possible without bringing down and restarting main processor 12. The method of the present invention monitors combustor 16 temperature by the thermocoupler and temperature transmitter 29.

When a drop of a predetermined number of degrees below a set point is detected, an incremental increase in burner air and auxiliary fuel is provided by the opening of burner air valve 25. Fuel valve 33 automatically is opened to maintain the proper air-to fuel ratio. This initial pulse of heat to combustor 16 is followed by a stepwise closing of air valve 25, which is followed by fuel valve 33, back to a valve position determined by temperature transmitter 29. This action typically will reverse the temperature drop in combustor 16. However, the condition usually associated with a crater is observed to be an excess of hydrocarbon components in hydrocarbon gas stream 14 resulting in a rich condition in combustor 16 resulting in sluggish recovery of the combustor temperature. Occasionally a second crater can occur. Therefore, in addition to the just described burner pulse, the combustion oxygen is monitored at oxygen analyzer 39 just after a crater. If the oxygen concentration stays a 0% for a set period of time, air valve 27 is stepped open to provide a step increase of primary air flow. This increase is repeated if the concentration remains at 0 for another period of time.

In the main process 12 for heating coal, a crater is anticipated when a temperature drop of 50° F. below set point is detected. At this point, valve 25 is opened to 70% open to provide a sensible heat pulse to the combustor. This is followed immediately by a 1% closing of the valve every five seconds until the valve reaches the position currently called for at the temperature transmitter 29. Additionally, if the oxygen concentration remains at 0 for 15 seconds after the crater is detected, valve 27 is opened an additional 10% to raise the primary air flow. This action will repeat if the oxygen concentration remains at 0 for an additional 15 seconds. Alternatively, if an optional combustibles detector 50 is connected to combustor 16, a low oxygen/high combustibles ratio (i.e. 0 oxygen/>0.5% combustibles) may be used to trigger the opening of valve 27. It will be appreciated that the combustibles detection device can be combined with the oxygen detector 39 in one device.

A final control scheme involves varying the burner air to auxiliary air ratio to improve combustion stability at high primary fuel combustion rates. During initial equipment heat-up, before hydrocarbons are available from main process 12, a stoichiometric air to auxiliary fuel ratio is maintained to provide oxygen deficient gas to preheat the processing equipment. Below 1450° F., this is accomplished by adjusting the relative positions of auxiliary fuel valve 33 and air supply valve 25 in response to the oxygen concentration detector 39. Above 1450° F., the temperature at which combustion of residual hydrocarbons from main process 12 can be accomplished safely, the air/auxiliary fuel ratio in burner 17 is maintained at a slight excess air condition. The oxygen concentration is then maintained by adjusting trim air valve 37 in response to the oxygen concentration detector 39. For example, in main process 12 for heating coal, the air/auxiliary fuel ratio is stepped up from 9.2:1 to 15.0:1 when primary air flow reaches 120,000 SCFH, or about 12 million BTU per hour firing rate. This step is reversed when the primary air flow drops below 100,000 SCFH.

EXAMPLE

Combustion of a lean hydrocarbon gas stream with a heating value of 30 BTU/std.ft$^3$ and an incoming temperature of 200° F. Combustion of this stream with a resulting gas temperature of 1750° F. and resulting oxygen concentration of 0.25%.

Ranges of operating conditions:

Fuel value of incoming gas stream 20 to 80 BTU/std. $ft.^3$

Temperature of incoming gas stream 100° to 900° F.

Combustion temperature 1400° to 2200° F.

Resulting oxygen concentration 0 to 2.0%

Resulting combustibles concentration 0 to 5.0%

It will be appreciated that the various changes and modifications may be made in the system of the present invention without departing from the scope of the appended claims. Therefore, the foregoing description and accompanying drawing are intended to be illustrative only and should not be construed in a limiting sense.

We claim:

1. A gas phase combustor control system for controlling the combustion of low calorific heating value gas streams generated by a main process at low oxygen concentrations comprising:

a gas phase combustor;

means for directing a low calorific heating value gas stream from a main process to the combustor;

means for direct immediate control of a temperature in the combustor;

means for direct immediate control of an oxygen concentration within the combustor;

means for detecting trends in pressure changes within the process and initiating preemptive compensation in combustion conditions in response to said trends in pressure changes; and means for detecting trends in temperature changes and initiating preemptive changes in combustion conditions within the combustor in response to the detected trends in temperature changes.

2. The system of claim 1 wherein said means for direct control of a temperature in said combustor further includes a burner, and means for varying an auxiliary fuel introduced to the burner.

3. The system of claim 2 further including means for measuring and transmitting the temperature in said combustor.

4. The system of claim 1 wherein said means for direct control of an oxygen concentration within said combustor further includes means for varying an amount of primary air introduced into said combustor.

5. The system of claim 4 wherein said means for varying an mount of primary air introduced into said combustor further includes a two stage control of primary air to provide a precise control of combustor oxygen concentration.

6. The system of claim 4 further including a means to measure and transmit oxygen concentration in said combustor.

7. The system of claim 6 wherein said means for detecting oxygen concentration also includes means for detecting a level of combustible hydrocarbons within said combustor.

8. The system of claim 1 wherein said means for detecting trends in pressure changes within said process further includes means for detecting pressure changes and air-flow changes across a plurality of air flow valves and air nozzles and means for initiating preemptive changes in said pressure and air flow.

9. The system of claim 8 wherein said means of initiating preemptive compensation in combustion conditions in response to said trends in pressure changes further includes means for activating a variable speed blower to compensate for pressure changes.

10. The system of claim 1 wherein said means for detecting trends in temperature changes within said combustor and initiating preemptive changes in combustion conditions within the combustor in response to the detected trends in temperature changes further includes means for detecting said temperature changes and means for stepping up heat input into said combustor, followed by temperature control.

11. The system of claim 10 wherein said means for detecting trends in temperature changes within said combustor and initiating preemptive changes in combustion conditions within the combustor in response to the detected trends in temperature changes further includes means varying a flow of auxiliary air to a burner and means for varying a flow of an auxiliary fuel to said burner of said combustor.

12. The system of claim 11 further including means for increasing a ratio of primary air to auxiliary fuel at a high primary air demand.

13. The system of claim 1 further including a plurality of flow measuring devices, one of said flow measuring devices disposed to measure and transmit a flow of air to a burner element of the combustor, one of said flow measuring devices disposed to measure and transmit a flow of auxiliary fuel to said burner, and one of said flow measuring devices disposed to measure and transmit a flow of primary air to said combustor.

14. A control system for controlling the combustion of low calorific heating value gas streams in a combustor having a primary fuels burner associated within it in response to changing process conditions comprising:

means for direct control of a temperature within the combustor including means for correcting a change in temperature by controlling an auxiliary fuel flow to the primary fuels burner;

a two stage temperature control means for controlling auxiliary fuel flow, said two stage temperature control means comprising means for maintaining combustor temperature during normal process conditions and a means for detecting and immediately correcting an abnormally fast temperature drop;

means for direct control of an oxygen concentration within the combustor including means for correcting oxygen concentration by controlling a flow of primary air into the combustor;

means for measuring changes in pressure within the process and for controlling air flow changes including means for maintaining a set pressure differential across air combustor air valves and air nozzles;

means for detecting and correcting temperature drops within the combustor including means for increasing heat input into the combustor;

means for detecting and correcting temperature drops within the combustor including means for increasing air input into the combustor; and a two stage control means for controlling a flow of primary air into the combustor.

15. The system of claim 14 further including means for controlling air pressure to compensate for pressure variations.

16. The system of claim 15 further comprising a variable speed blower.

17. A method for controlling the combustion of low heating value gas stream in a combustor comprising the steps of:

controlling a temperature by varying an auxiliary fuel to air ratio introduced to a burner of the combustor;

controlling an oxygen concentration by varying a primary air flow introduced to the combustor;

detecting pressure changes and air flow changes within an associated process;

correcting the pressure changes and air flow changes to the combustor by maintaining a set pressure differential across a plurality of combustor air valves and air inlet nozzles;

detecting trends in temperature drops within the combustor resulting from a loss of hydrocarbon combustion; and correcting the temperature drops by increasing heat input into the combustor.

18. The method of claim 17 wherein the step of correcting the temperature drops further includes the step of increasing air flow into the combustor.

19. The method of claim 17 wherein said step of correcting the temperature drops further includes automatically enriching a burner air to auxiliary fuel ratio at high primary air demands.

20. A system for heating a bed of coal and using the hydrocarbon gas generated during the heating process as fuel to heat the coal comprising:

a main processor for holding a bed of coal for heating;

a combustor operatively associated with the main processor and disposed to burn a hydrocarbon gas produced in the main processor;

a burner system within the combustor;

valve means for controlling the flow of air to the burner system;

an auxiliary fuel supply disposed to provide auxiliary fuel to the burner system;

means for directing a hydrocarbon gas from the main processor to the combustor;

a pressure analyzer for monitoring the pressure of the gas flowing from the processor to the combustor;

control means for monitoring the temperature within the combustor and adjusting the flow of air and auxiliary fuel to the burner system based upon the temperature, said control means comprising means for maintaining a process temperature and means for rapidly correcting a drop in temperature;

control means for monitoring the pressure within the combustor and adjusting the flow of air to the burner system based upon the pressure within the combustor.

* * * * *